US006622936B2

(12) United States Patent
Boecking

(10) Patent No.: US 6,622,936 B2
(45) Date of Patent: Sep. 23, 2003

(54) PRESSURE-REGULATED INJECTOR WITH PRESSURE CONVERSION

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/010,332

(22) Filed: Nov. 8, 2001

(65) Prior Publication Data

US 2002/0066799 A1 Jun. 6, 2002

(30) Foreign Application Priority Data

Nov. 8, 2000 (DE) ..... 100 55 269

(51) Int. Cl.[7] ..... F02M 47/02
(52) U.S. Cl. ..... 239/89; 239/95; 123/446
(58) Field of Search ..... 239/88–96, 124–127, 239/102.2, 533.2, 533.12; 123/446, 467

(56) References Cited

U.S. PATENT DOCUMENTS 4,459,959 A * 7/1984 Terada ..... 123/446
4,527,737 A * 7/1985 Deckard ..... 239/89
5,622,152 A * 4/1997 Ishida ..... 123/446
6,328,017 B1 * 12/2001 Heinz et al. ..... 123/467

FOREIGN PATENT DOCUMENTS

DE 198 35 494 A1 2/2000
EP 0 457 642 A1 11/1991

* cited by examiner

*Primary Examiner*—Michael Mar
*Assistant Examiner*—Dinh Q. Nguyen
(74) *Attorney, Agent, or Firm*—Michael J. Striker

(57) ABSTRACT

An injector for injecting fuel into a combustion chamber of an internal combustion engine has a nozzle needle having a nozzle chamber with a nozzle inlet, a pressure convertor with a pressure chamber, two control valves arranged after the pressure convertor and having one control valves which releases and closes the nozzle inlet to the nozzle chamber of the nozzle needle, control chambers, and a high pressure line through which the control chambers and the pressure chamber of the pressure convertor are loaded with high pressure, one of the control chambers of the pressure convertor being connected by one of the control valves, while the nozzle inlet is provided with high pressure.

9 Claims, 2 Drawing Sheets

PRESSURE-REGULATED INJECTOR WITH PRESSURE CONVERSION

BACKGROUND OF THE INVENTION

The present invention relates generally to fuel injection systems for internal combustion engines.

More particularly, the present invention relates to a pressure-regulated, fuel injector having pressure conversion or multiplication.

With direct injection engines, the supply of fuel to the combustion chamber of the internal combustion engine takes place through a fuel injection system, which includes injectors. The injectors of the combustion engine are supplied with fuel by means of a high pressure collecting chamber, or a common rail. By means of the electrically controllable injectors, the initiation of the injection process, the injected amount of the fuel, and the injection pressure process are provided for via the injection process. The injectors take the place of the formerly used nozzle holder bodies.

Patent Documents EP 0 457 642 A2 relates to a fuel injection device for a combustion engine. A high pressure fuel pump fills a high pressure collecting chamber, or common rail, from which high pressured lines lead to the particular injection valves. Thereby, control valves for controlling the high pressure injection to the injection valves, as well as an additional pressure storage chamber, are placed in the particular high pressure lines. In order to avoid the high system pressure lying constant on the injection valves, the control valve is constructed so that, during the injection pause, it closes the connection between the injection valve and the pressure storage chamber and regulates a connection between the injection valve and a release chamber.

Patent document DE 198 35 494 A1 discloses a pump-nozzle unit, which serves to supply the fuel in a combustion chamber of a direct injection internal combustion engine. A pump unit is provided, with which an injection pressure is created. Fuel is injected via an injection nozzle into the combustion chamber. The pump-nozzle unit includes a control unit as well as a control portion. The control unit is formed as an outwardly opening A-valve and by means of a valve operating unit, is controllable for regulation the pressure build-up in the pump unit. In order to create a pump-nozzle unit with a control unit, which has a simple construction, which is compact, and has a short response time, the valve-operating unit is formed as a piezo electric actor.

SUMMARY OF THE INVENTION

It is therefore an object of the present invention to provide a pressure-controlled injector which avoids the disadvantages of the prior art.

In keeping with these objects and with others which will become apparent hereinafter, one feature of present invention resides, briefly stated, in a pressure-controlled injector with a pressure conversion which has a nozzle needle having a nozzle chamber with a nozzle inlet; a pressure convertor; two control valves arranged after said pressure convertor and including one control valve which releases and closes said nozzle inlet to said nozzle chamber of said nozzle needle; control chambers; and a high pressure line through which said control chambers and a pressure chamber of a pressure convertor are loaded with high pressure, one of said control chambers of said pressure convertor being connected by one of said control valves, while said nozzle inlet is provided with high pressure.

In fuel injection devices which include pressure conversion, a high conversion ratio is necessary for small primary pressures.

With the inventive solution, an injector for injecting high pressure fuel into the combustion chamber of an internal combustion engine is provided which has compact dimensions so that it can be placed on the cylinder head of a direction injection internal combustion engine, without requiring additional space. A constant high pressure is placed on the pressure convertor via the high pressure collecting chamber, or common rail, so that a short response time can be realized on the pressure convertor. The permanently high control pressure enables the injector to operate quite efficiently.

In accordance with the invention, the pressure convertor is connected to a 3/2-way control valve, with which a release of the nozzle in the direction of waste oil run-off in a closed position is possible. In this manner, the compression, or pressure load, that is the mechanical continuous load of the nozzle needle component, is significantly reduced. A control pressure accrues in front of the control portion via a direct connection from the pressure chamber of the pressure convertor. The pressure convertor itself is regulated through a 2/2-way control valve. In a preferred embodiment, the 3/2-way control valve which releases the nozzle needle, as well as the 2/2-way control valve, can be connected parallel to one another via a common regulating unit. On the pressure convertor, force equalization can thereby be achieved such that in the upper control chamber, the intermediate control chamber, and the pressure chamber a constant control pressure prevails. The locking spring, which is located in the intermediate control chamber beneath the enlarge head area of the piston-type pressure convertor element, contains this control pressure in its starting position.

The pressure chamber below the piston element of the pressure convertor is ensured against a pressure loss by a reloading valve; this valve lies on the inlet side of the pressure from the branch or shunt from the pressure of the high pressure collecting chamber, or common rail. To produce a very high control pressure, the pressure convertor is serially connected to both control valves. A pressure level of the pressure in the high pressure collecting unit (common rail) lies against all of the control chambers of the pressure convertor, as well as its pressure chamber. Pressure pulsations do not take effect in control pressure fluctuations. The stored fuel column in the high pressure collecting chamber (common rail) damp these to the point that no effect on the pressure level to the injector can occur.

DESCRIPTION OF THE PREFERRED EMBODIMENTS

Figure 1:
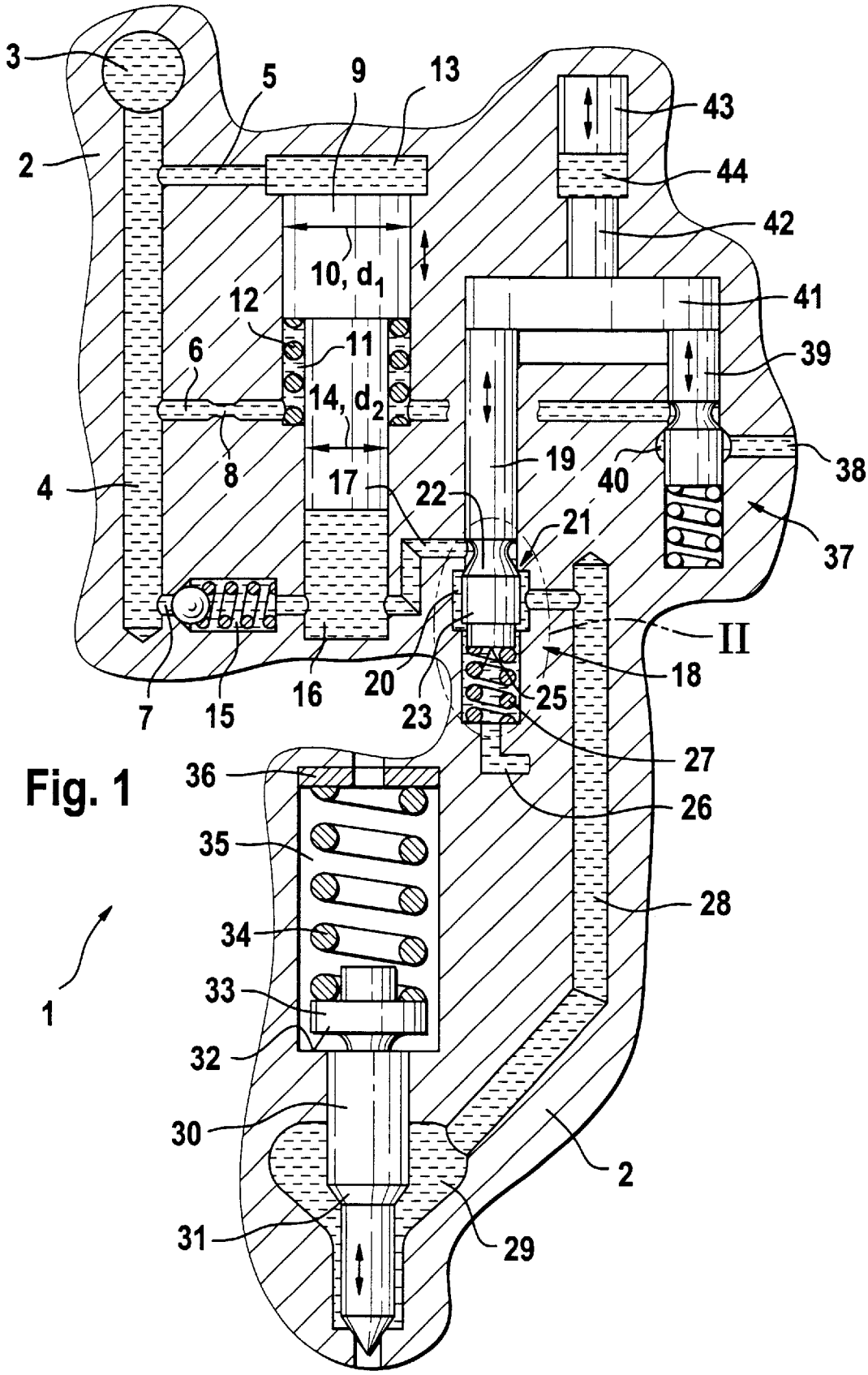
FIG. 1 shows a pressure convertor to which are coupled a 3/2-way control valve and a 2/2-way control valve.

FIG. 1 shows an inventive injector having a pressure convertor that is associated with both a 3/2-way valve and a 2/2-way control valve.

The injector 1 according to FIG. 1 comprises generally a pressure convertor 9 and two, parallel connected control valves 18, 37, as well as a vertically ascendable nozzle needle in an area beneath the injector. The above components are all contained within the injector housing 2 of the injector, as shown in FIG. 1.

Control or pressure chambers of the pressure convertor 9 are loaded with highly pressurized fuel, which represents a control pressure in the control chambers of the pressure convertor, by means of a high pressure collecting chamber 3, which here is only schematically represented, and a high pressure line 4 extending from the chamber 3. A control chamber 13 above the upper face of the piston-type pressure convertor element of the pressure convertor 9 is loaded with control pressure via an upper control chamber shunt 5. The head area of the piston-type control convertor element has a diameter 10, to which a second diameter area 14 ($d_2$) of the piston-type pressure convertor element is connected, which has a smaller diameter than the diameter 10. At the transition point from the head area in the narrow diameter area of the piston-type pressure convertor element, a circular surface is formed. Between the narrow area of the piston-type pressure convertor and the bore in the injector housing 2, an intermediate control chamber 11 is formed. In the intermediate control chamber 11, a locking spring is inserted, which on one side is braced on the floor of the intermediate control chamber 11 in the injector housing 2 and on the other side, lies against the circular surface of the piston-type pressure convertor element, which is formed at the transition from the head area in the narrow portion of the piston-type pressure convertor element. The lower face of the narrow area of the pressure convertor element, which has a smaller diameter 14, projects into a pressure chamber 16 in the injector housing 2.

The intermediate control chamber 11, in which a spiral-shaped locking spring 12 is housed, is loaded from the high-pressure supply line 4 via an inlet 6, in which an inlet nozzle throttle 8 is disposed. In addition, the intermediate control chamber 11 of the pressure convertor is connected with a 2/2-way valve 37, by which it is switchable.

A pressure chamber inlet 7 projects further from the high pressure inlet 7 from the high pressure collecting chamber 3, the common rail. Through the pressure chamber inlet 7, the pressure chamber 16 in the injector housing 2 of the injector 1 is loaded with high pressure fuel. A re-loading valve 15 is inserted in the inlet 7 to the pressure chamber, which can be configured as a ball valve whose ball body is pressed into its seating by means of a pressure spring. The pressure in the high pressure collecting chamber 3 opens the re-loading valve 15, so that a reloading of the pressure chamber 16 of the pressure convertor 9 in the injector housing 2 is ensured. On the contrary, a leaking of the high pressure fuel from the pressure chamber 16 in the high pressure supply line 1 is not possible. The pressure chamber 16 in the injector housing 2 of the injector 1, according to the representation in FIG. 1, is connected with a 3/2-way control valve, which is in turn connected parallel to a 2/2-way control valve 37, via a return passage 17.

While the 3/2-way control valve 17 closes off or opens up the pressure loading of a nozzle inlet 28 to the nozzle chamber 29 in the injector housing 2, the 2/2-way control valve 37 in the injector housing 2 serves to actuate the pressure convertor 9. Both vertical lift movements from of the valve bodies 19, 39 of the control valves 18, 37, respectively, takes place preferably through a common regulator 43, which, by way of example, can be a piezo actor. Through the intermediary of a hydraulic convertor 44, an armature (anchor?) 42 can move upwardly or downwardly in a vertical direction in the injector housing 2 by means of the common regulator. The armature 42 is furnished with a bridge 41, which is parallel to one of the two valve bodies 19, 39 of the control valves 18, 37, respectively.

The 3/2-way control valve 18 in the injector housing 2 comprises a valve body 19, which moves up and down in a vertical direction in the injector housing 2 via the bridge 41. The valve body 19 is provided with a single cord point in the area of the opening of the return passage 17 from the pressure chamber 16 in the injector housing. The single cord point runs out to the injector body 19 in a valve diameter 22. By means of the valve diameter 22 on the valve body 19, a valve chamber 20 of the 3/2-way control valve 18 in the injector housing 2 is sealed against the high pressure in the pressure chamber 16, or in the return passage 17. At a lower end of the valve chamber 20, the valve body 19 of the 3/2-way control valve comprises a slider element 23. At the lower end of the valve body 19, a lower face of the valve body 19 is found, which is loaded via a spring element, such as a spiral spring. The spring element 27 is braced in a hollow chamber, which serves as a waste oil chamber in the injector housing. The hollow chamber, which encompasses the spiral spring element 27, can be connected to the fuel reservoir of the internal combustion engine by a waste oil line 26.

A nozzle inlet 28 branches off from the valve chamber 20, the nozzle inlet 28 being connected to the valve chamber 20 of the injector housing 2 by a transverse bore in the injector housing 2. Upon opening of the valve diameter 22 from its seating in the injector housing 2, that is, the downwardly shifted valve body 19 of the 3/2-way control valve 18 closes off the valve chamber 20 via the return passage 17 from the high pressure fuel in the nozzle inlet 28. The nozzle inlet 28 opens into a nozzle chamber 29, which is likewise formed in the injector housing 2. The nozzle chamber 29 encompasses a nozzle needle 30, which is provided with a pressure stage 31. A contact piece 33 is disposed above the upper face 32 of the nozzle needle 30. One side of the contact piece 33 lies against the face 32 of the nozzle needle 30 and another side is acted upon by a sealing spring 34. The sealing spring 34 is disposed in a hollow chamber 35 on the injector housing side and is supported on a support element 36. When there is a high pressure level in the nozzle inlet 28, and therewith in the nozzle chamber 29, the pressure stage 31 operates a vertical ascent of the nozzle needle 30 counter to the operation of the sealing spring 34 in the hollow chamber. The nozzle needle 30 moves upwardly and opens the injection opening. High pressure fuel is then injected into the combustion chamber of a direct injection internal combustion engine.

Parallel to the 3/2-way control valve 18, a 2/2-way control valve 27 is provided in the injector housing 2 of the injector, according to the representation of FIG. 1. This 3/2-way control valve 18 serves to regulated the pressure convertor 9. The valve body 39 of the 2/2-way control valve 37 is likewise connected with the bridge 41, which acts upon the valve body 19 of the 3/2-way control valve 18. In this manner, both control valves 18, 37 are regulated parallel. The 2/2-way control valve 37 serves as an actuator for the pressure convertor 9. The valve chamber surrounded the valve body 39 of the 2/2-way control valve opens into a waste oil line 38, through which the intermediate control chamber 11 is pressure-releasable. The lower face of the valve body 39 is acted upon by a spring element for biasing of the valve body 39 in the injector housing 2, so that the valve diameter of the valve body 39 in its closed position constantly lies against the housing seat in the injector housing 2.

The operation of the device shown in FIG. 1 is as follows:

By the high pressure inlet 4, which extends from the high pressure collecting chamber 3, or the common rail, the upper control chamber 13 is placed under pressure via the shunt 5; the intermediate control chamber 11 is placed under pressure via the inlet 6; and the pressure chamber 16 of the pressure convertor 9 is placed under pressure by the lower inlet 7 with the reloading valve 15. In the closed position of both control valves (the 3/2-way control valve 18 and the 2/2-way control valve 37), the pressure chamber 16 of the pressure convertor 9 is closed off from the nozzle inlet 28, and the intermediate control chamber 11 of the pressure convertor 9 is also closed. In this position, the piston-type pressure conversion element of the pressure convertor 9 is held in its starting position by the closure spring 12 in the intermediate control chamber 11. The piston-type pressure conversion element of the pressure convertor 9 is pressure-or force-equalized, since the control pressure prevails in the control chamber 13, in the intermediate control chamber 11, as well as in the pressure chamber 16. Upon charging of the common regulator 43, the bridge 41 connecting the two valve bodies 19, 39 of the two control valves 18, 37, respectively, descends and moves the valve body 19, 39 vertically downward. This causes the valve body 39 of the 2/2-way control valve 37 to release the pressure in the intermediate control chamber 11 of the pressure convertor 9 so that the pressure convertor moves downwardly against the effect of the sealing spring 12 in the injector housing. This causes an increase in the pressure in the pressure chamber 16 in the injector housing 2.

At the same time, the pressure chamber 16, in which the pressure rises, is connected with the nozzle inlet 28 by the return passage 17 and the release of the valve diameter 22 on the injector housing 2 through the vertical downward movement of the valve body 19 of the 3/2-way control valve 18. Thereby, compressed fuel is closed from the pressure chamber 16 by the nozzle inlet 28 in the nozzle chamber 29, which causes a vertically upward movement of the nozzle needle 30 in the injector housing 2. In this manner, high pressure fuel can be injected into the combustion chamber of a direct injection internal combustion engine.

The closing of the valve bodies 19, 39 of the control valves 18, 37, respectively, takes place through a vertically upward movement of the valve body 19, 39 in the injector housing 2. The valve bodies 19, 39 are pressed with their valve diameters 22 into their sealing seats in the injector housing 2 by the spring element, which acts upon the lower face of the valve bodies 19, 39. Pressure formation takes place in the intermediate control chamber 11 of the pressure convertor 9 so that, supported by the closure spring 12, the pressure convertor extends with its narrow area in the diameter 14 from the pressure chamber, and there, a pressure drop takes place. At the same time, the nozzle inlet 28 is pressure-released by the slider element 23 through ascent of the valve body 19 of the 3/2-way control valve 18 and descent of its valve diameter 22 into the seating in the injector housing 2.

Figure 2:
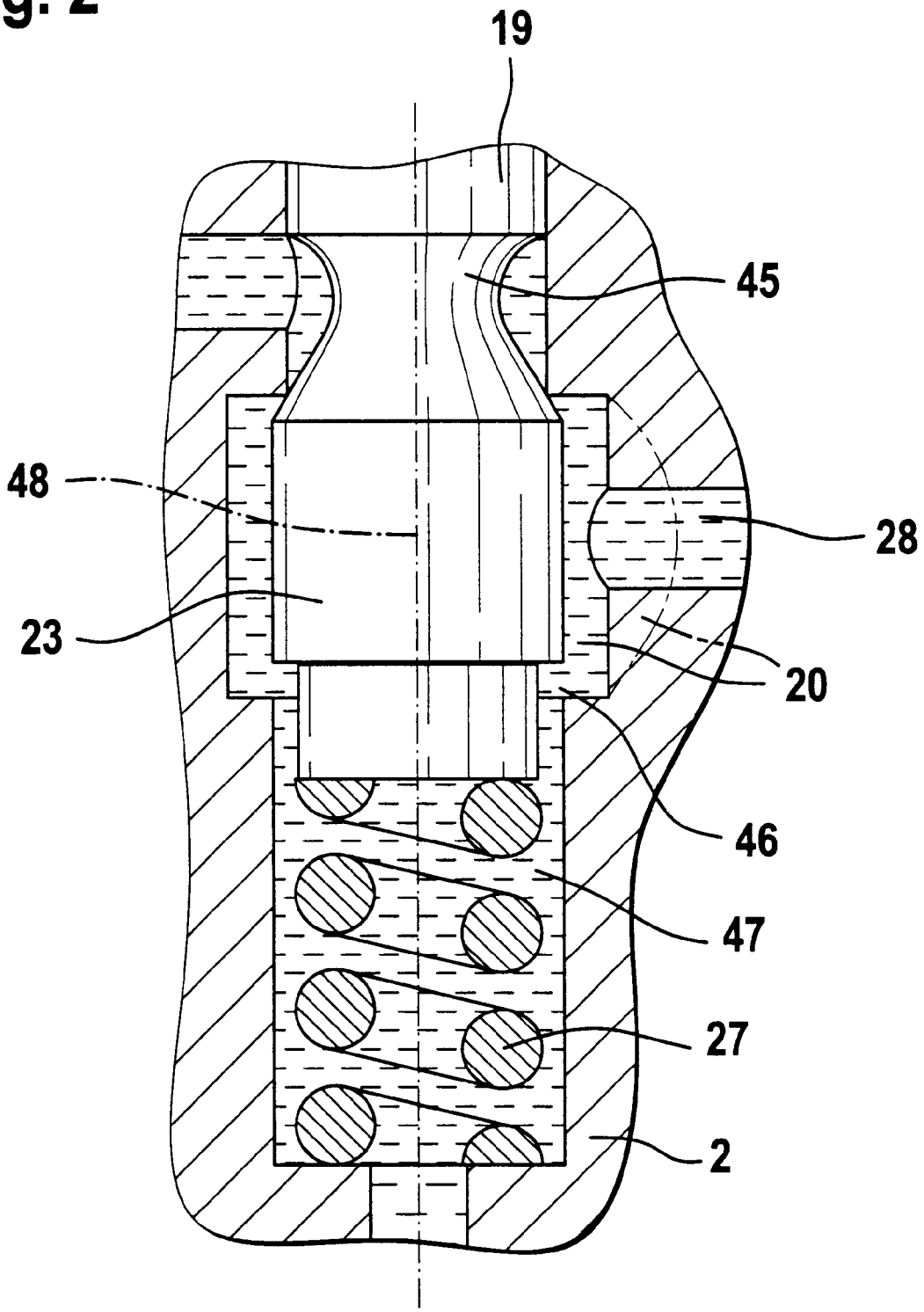
FIG. 2 shows, in an enlarged scale, the valve body of the 3/2-way control valve in the slide area.

FIG. 2 shows the injector body 19 of the 3/2-way control valve 18 in the area of the slider and the housing-side control face in an enlarged representation.

The valve chamber 20, which surrounds the valve body 19 of the 3/2-way control valve 18 in the injector housing 2 in a rounded or slanted form, serves for releasing the pressure of the nozzle inlet 28 into the waste oil chamber 47. The slider 23 is provided opposite thereto on the valve body 19 of the nozzle inlet 28, beneath a single cord position 45, which runs symmetrically to a symmetrical axis 48 of the valve body 19 of the 3/2-way control valve. During the closing of the valve body 19 with its valve diameter 22 in the housing seat 21, the pressure is built up around the nozzle inlet 28 via the valve chamber 20 through the opened annular column 46 between the slider element and the control face in the waste oil chamber 47. That is, the nozzle inlet 28 is released upon the closing process in the direction of the waste oil chamber 47. At the same time, it is ensured that the high control pressure in front of the valve body 19 of the 3/2-way control valve 18 can be maintained and, in this manner, also a small conversion ratio can be maintained, which is basically defined by the ratio of the head diameter 10 to the throat diameter 14 of the piston-type pressure conversion element of the pressure convertor 9.

The opening pressure of the nozzle needle 30 upon application of a high pressure in the nozzle chamber 29 is determined through the formation of the pressure stage 31, as well as the closing force of the sealing spring 34. The pressure release of the nozzle inlet 28, or the nozzle chamber 29, in the closed position occurs through the maintenance of an annular column 46 between the slider portion of the valve body 19 and the opposite control face on the injector housing 2.

It will be understood that each of the elements described above, or two or more together, may also find a useful application in other types of constructions differing from the types described above.

While the invention has been illustrated and described herein as a fuel injector with a pressure convertor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An injector for injecting fuel into a combustion chamber of an internal combustion engine, comprising a nozzle needle having a nozzle chamber with a nozzle inlet; a pressure convertor with a pressure chamber and control chambers; two control valves arranged after said pressure convertor and having one control valves which releases and closes said nozzle inlet to said nozzle chamber of said nozzle needle; and a high pressure line through which said control chambers and said pressure chamber of said pressure convertor are loaded with high pressure, one of said control chambers of said pressure convertor being connected by one of said control valves, while said nozzle inlet is provided with high pressure; and a reloading valve arranged between said high pressure line and said pressure chamber of said pressure convertor.

2. An injector as defined in claim 1, wherein during a pressure release of a lower one of said control chambers and said pressure convertor through one of said control valves which is formed as a 2/2-way control valve, said nozzle inlet is connected with a return passage and said pressure chamber of said pressure convertor.

3. An injector for injecting fuel into a combustion chamber of an internal combustion engine, comprising a nozzle needle having a nozzle chamber with a nozzle inlet; a pressure convertor with a pressure chamber and control chambers; two control valves arranged after said pressure convertor and having one control valves which releases and closes said nozzle inlet to said nozzle chamber of said nozzle needle; and a high pressure line through which said control chambers and said pressure chamber of said pressure convertor are loaded with high pressure, one of said control chambers of said pressure convertor being connected by one of said control valves, while said nozzle inlet is provided with high pressure; said pressure convertor has a head region provided with a first diameter which exceeds a diameter in a lower region of said pressure convertor at a control end surface which faces said pressure chamber.

4. An injector for injecting fuel into a combustion chamber of an internal combustion engine, comprising a nozzle needle having a nozzle chamber with a nozzle inlet; a pressure convertor with a pressure chamber and control chambers; two control valves arranged after said pressure convertor and having one control valves which releases and closes said nozzle inlet to said nozzle chamber of said nozzle needle; and a high pressure line through which said control chambers and said pressure chamber of said pressure convertor are loaded with high pressure, one of said control chambers of said pressure convertor being connected by one of said control valves, while said nozzle inlet is provided with high pressure, wherein one of said valves which is located at a side of said nozzle chamber is a 3/2-way control valve; and further comprising a passage through which said pressure chamber of said pressure convertor is connected with a valve chamber of said 3/2-way control valve.

5. An injector as defined in claim 4, wherein the other of said control valves is formed as a 2/2-way control valve; and further comprising common regulator through which said 3/2-way control valve and said 2/2-way control valve are operated parallel.

6. An injector as defined in claim 5, wherein said valves have valve bodies with identically oriented seating surfaces.

7. An injector as defined in claim 4, and further comprising a waste oil slider element is formed in a lower area of a valve body of said 3/2-way control valve.

8. An injector for injecting fuel into a combustion chamber of an internal combustion engine, comprising a nozzle needle having a nozzle chamber with a nozzle inlet; a pressure convertor with a pressure chamber and control chambers; two control valves arranged after said pressure convertor and having one control valves which releases and closes said nozzle inlet to said nozzle chamber of said nozzle needle; and a high pressure line through which said control chambers and said pressure chamber of said pressure convertor are loaded with high pressure, one of said control chambers of said pressure convertor being connected by one of said control valves, while said nozzle inlet is provided with high pressure; and a closure spring provided on said pressure convertor in a region of a central one of said control chambers.

9. An injector as defined in claim 8, wherein said control valves are formed so that during displacement of said 3/2-way control valve and said 2/2-way control valve to control pressure buildup is performed in a central one of said control chambers of said pressure convertor and a connection of said nozzle inlet is provided through a slider on a valve body toward a waste oil chamber.

* * * * *